United States Patent [19]

Lewis

[11] 4,359,171

[45] Nov. 16, 1982

[54] CONTAINER COVER LOCKING ASSEMBLY

[75] Inventor: Duane H. Lewis, Claysville, Pa.

[73] Assignee: Continental Plastics, Inc., Triadelphia, W. Va.

[21] Appl. No.: 287,707

[22] Filed: Jul. 28, 1981

[51] Int. Cl.[3] ..... B65D 39/00

[52] U.S. Cl. ..... 220/307; 220/339; 222/565; 222/569

[58] Field of Search ..... 220/307, 339; 222/565, 222/569, 153, 566, 480, 556

[56] References Cited

U.S. PATENT DOCUMENTS

| | | | |
|---|---|---|---|
| 3,542,235 | 11/1970 | Hidding | 220/339 |
| 3,675,812 | 7/1972 | Foster | 222/565 |
| 3,907,156 | 9/1975 | Weathhend | 220/307 |
| 4,177,932 | 12/1979 | Cheevehy | 220/307 |
| 4,280,636 | 7/1981 | Lewis | 220/307 |

*Primary Examiner*—George T. Hall

*Attorney, Agent, or Firm*—Parmelee, Miller, Welsh & Kratz

[57] ABSTRACT

An improved container cover locking assembly has a base member with a continuous peripheral skirt depending therefrom and a ridge parallel to yet spaced inwardly from the skirt along the underside of the base member. Tapered locking lips depend downwardly from the ridge, extend along a substantial portion thereof and curve outwardly toward, yet terminate short of, the skirt. At least one support rib is vertically disposed along each of the locking lips to stiffen the lips in the normal locking position. The locking assembly allows a simplified molding process for a container cover which is assembled with a container body of the type having a curved mounted seat formed from the upper edge of the containers's walls.

8 Claims, 3 Drawing Figures

CONTAINER COVER LOCKING ASSEMBLY

BACKGROUND OF THE INVENTION

1. Field of the Invention

The invention is directed toward the locking means used to removably secure container covers to container bodies. More particularly, this invention is directed to an improvement of the container cover locking assembly disclosed in my patent, U.S. Pat. No. 4,280,636 which is assigned to the assignee of this application.

2. Prior Art

Prior to the locking assembly disclosed in my U.S. Pat. No. 4,280,636, "Container Cover Locking Assembly", which is incorporated herein by reference, it had been the practice to manufacture a container cover comprising a planar member with a continuous peripheral skirt and a locking member depending from the underside of the planar member, the skirt and locking member being in a parallel spaced relation. A continuous bead was molded onto the side of the locking member facing the skirt. When the cover was assembled with a container body of the type having a cover mounting seat formed from the inwardly curled upper edge of the body's side walls, the continuous bead projected out from the locking member and extended below the curled mounting seat. The bead thereby inhibited upward motion of the cover relative to the container body. Typically, such a container cover and container body are generally, but not exclusively used for the packaging of solid particulate matter such as powered condiments.

Such locking members, as described above, are shown in U.S. Pat. Nos. 3,542,235; 3,370,757 and 3,675,812. These container covers are usually manufactured by an injection molding process which requires that the mold chamber of the locking member and bead be opened separately prior to the release of the cover from the mold. The complicated mold with movable chamber segments required to produce such a cover was eliminated by my container cover locking assembly which permits the use of a simplified mold design during manufacture.

It is an object of this invention to provide an improved container cover locking assembly having additional rigidity without interfering with either the simplified mold design or the functioning of the locking lip.

SUMMARY OF THE INVENTION

The invention consists of an improved locking assembly for a container cover used in combination with a container body of the type having a cover mounting seat which is formed from the inwardly curved upper edge of the body's side panels. The container cover comprises a base member with a continuous skirt depending downwardly from the periphery of the base member and a continuous ridge spaced inwardly from, yet parallel with the skirt, along the underside of the base member. The skirt together with the ridge and the portion of the underside of the base thereinbetween from a mounting channel which rests on the container mounting seat. Resilient tapered locking lips with at least one approximately vertical support rib attached thereto, depend from the ridge and curve outwardly toward, yet terminate short of, the depending skirt. The several locking lips extend laterally along the ridge for a substantial portion of the perimeter of the base member. The spaced relation of the locking lip relative to each other insures that the flexibility needed to assemble the cover onto the container body will be present in the locking assembly. The support rib stiffens the locking lip once the container cover is mounted onto the container body yet still facilitates the locking lip's flexibility.

The cover is integrally molded from a resinous material which imparts sufficient resiliency to the locking lips which can flex away from the skirt as required and then return to a normal position. The support ribs impart an additional measure of stiffness to the locking lips when the locking lips are in their normal position.

DETAILED DESCRIPTION OF THE INVENTION

The improved locking assembly of this invention is described with a container cover having incorporated therein means for dispensing the contents of a container on which the cover is mounted. Such a dispensing configuration is typical of most containers of this type presently in use. The improved locking assembly is, of course usable with a variety of styles of container covers. For example, the container cover might include a solid base member which would have to be removed in order to gain access to the contents of the container. The container body itself might even include a dispensing means therein so that the container cover would likely never be removed or at least not until the container's contents were depleted and refilling of the container was necessary.

Figure 1:
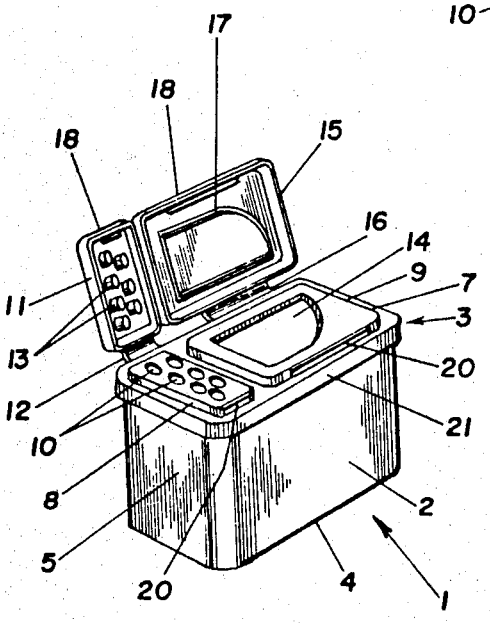
FIG. 1 is a perspective view of a container assembly in accordance with the invention.

As can be seen in FIG. 1, a container assembly indicated generally by the reference character 1 includes a container body 2 and a container cover 3 which incorporates the features of this invention. The container body 2 is conventional in design and manufacture with a bottom member 4 and a continuous side wall 5 which extends from the bottom member and terminates in an inwardly curved mounting seat 6, which is clearly visible in FIG. 2. It is upon this seat 6 that the cover 3 is detachably mounted and secured. The container cover 3 comprises a base member 7 with two decks thereon, a sifting deck 8 and a pouring or spooning deck 9. The sifting deck 8 has a plurality of orifices 10 which are cone like in shape, with the wider position of the cone at the top of the deck 8. A sifting deck cap 11 is attached to the cover base by means of flexible member 12. Sealing cones 13 protrude from the insides of the shaker deck cap and are aligned so as to mate with the orifices 10 thus providing a sealing means for the shaker orifices. A spooning deck 9 is provided with an opening 14 which is of sufficient size to permit the passage of a spoon or similar measuring device into the container assembly. A deck cap 15 is also provided for the spooning deck and is attached to the base member 7 by a flexible member 16. On the inside face of cap 15 is a continuous protruding flange 17 which mates with the perimeter of opening 14 and acts as a sealing means for said opening.

Figure 2:
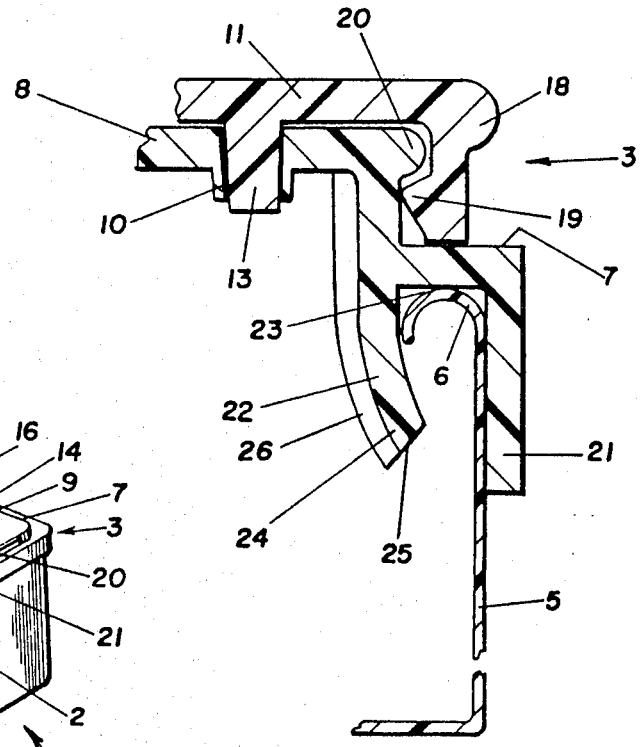
FIG. 2 is a partial, vertical, sectional view through a container assembly incorporation the invention, taken along the line II—II in FIG. 3.

Turning now to FIG. 2, the relationship of the sealing cones 13 and the sifting orifices 10 when the deck cap 11 is closed over deck 8 is clearly shown. The deck cap 11 is provided with off set beads 18 and 19. Bead 18 serves as a lifting point for urging the deck cap free of the sifting orifices. The inner bead 19 interlocks with a deck bead 20 and secures the deck cap 11 firmly onto the sifting deck 8. The cap 15 which closes the opening 14 in the spooning deck 9 is molded with the same bead configuration in order to removably fasten the cap 15 in a closed position over spooning deck 9.

Figure 3:
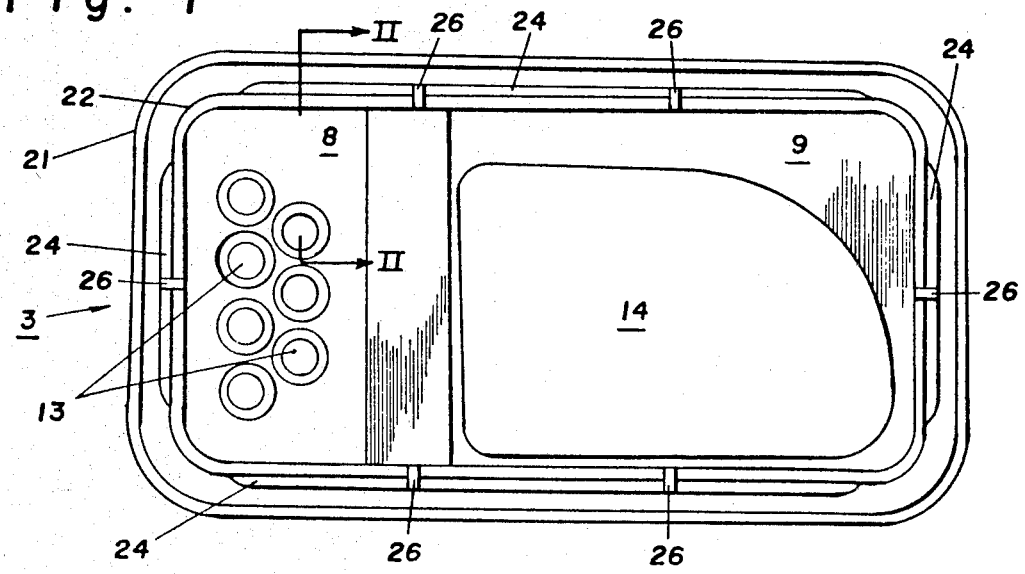
FIG. 3 is a plan view of the underside of the container cover of this invention.

The container cover is provided with an improved locking means by which it can be removably mounted and secured to a container body. At the periphery of the container cover base member 7 is a downwardly depending continuous skirt 21 which overlaps the side wall of the container body. Inwardly spaced in a parallel relation with the skirt 21 there is a continuous ridge 22 which together with the skirt 21 and the underside of the base member 7 between the skirt and the ridge form a mounting channel 23. The mounting channel 23 is generally contiguous with the mounting seat 6 of the container body when the cover and container are assembled as shown in FIG. 1. The mounting channel provides a seal which inhibits entry of foreign matter in the container's contents by way of the mounting assembly area. The cover is removably secured to the container body by means of flexable locking lips 24 which depend from the ridge 22. The locking lips 24 curve outwardly toward, yet terminate short of the depending skirt 21. A beveled edge 25 is formed at the terminal portion of each locking lip 24 in order to facilitate the mounting of the cover onto a container body. As illustrated in FIG. 3, the locking lips 24 can extend laterally along the ridge 22 for a substantial portion of the edge of the base member 7. Considering both FIGS. 2 and 3, it can be seen that each lip 24 is provided with at least one supporting rib 26 attached thereto. The ribs 26 are arranged with a substantially perpendicular component relative to the edge of the base member 7 and are arranged in a spaced relation along the inwardly facing surface of the locking lips 24. The supporting ribs 26 stiffen said locking lips once the container cover is mounted onto the container body without providing undesirable resistance when mounting the container cover onto or removing the container cover from the container body. When the container cover 3 is correctly mounted onto a container body, the locking lips 24 curve around the lower portion of the mounting seat 6 and urge the mounting channel 23 down against the upper surface of the mounting seat.

The supporting ribs 26 are evenly spaced along the length of the locking lips 24 on the face of each lip opposite the mounting channel 23 and extend from the bottom of the base member 7 to the beveled edge 25 of the locking lip.

In one configuration, the container cover base member 7 is rectangular and the locking lips 24 extend along a substantial portion of each edge of the base member. Unlike the continuous skirt and ridge, the locking lips do not intersect at the corners of the base members. As a result, there is an open area or notch between perpendicularly situtated locking lips. The notch allows the lips to flex away from the skirt toward the center of the container cover whereby the container cover can be mounted onto or removed from a container body. The beveled terminal portion 25 of the locking lip 24 is useful during the container cover mounting process. When the cover is aligned over the container body for mounting, the locking lip 24, in its normally closed position would impede the mounting by possibly closing the channel 23. The beveled edge 25 rides down over the inside edge of the curled mounting seat 6 and urges the lips away from the skirt. Once the beveled edge is beyond the inside edge of the mounting seat, the lips return to their normally closed position and bias the cover down against the container body. The supporting ribs 26 stiffen the locking lips 24 when the lips are in the normally closed position yet allow the lips to flex out away from the skirt.

A significant advantage of the locking lips design is the simplification of the mold required to manufacture the container cover. Because the locking lip 24 is flexible the cover can be simply pushed free of the mold. The lip rides upwardly over that portion of the mold which defines the mounting channel 23. In a conventionally designed container cover, the mold would be of multiple sections which would have to be disengaged from the locking bead before the cover could be released from the mold. Because the ribs 26 are transverse to the longitudinal axis of the ridge 22, they do not interfere with mold disengagement process.

Because of the simplification of the mold used in the manufacture of a container cover incorporating the features of the improved locking assembly, the distance which the peripheral skirt 21 depends downwardly from the base member 7 relative to the locking lip is variable. However in the preferred embodiment, the skirt extends below the locking lip. This configuration allows the container cover to be properly aligned with the container body mounting seat before any movement of the locking lips away from the skirt takes place.

While the embodiment described herein has been directed toward a rectangular container cover, it is possible to incorporate the improved securing means of the instant invention into container covers of various shapes. For example, a circular container cover could be provided with a plurality of arcual locking lips, each of which included at least one supporting rib. The arcual locking lips would cooperate with the mounting seat of a circularly shaped container body.

What is claimed is:

1. A locking assembly for a container cover used with a container body of the type having a cover seat formed from the inwardly curved upper edges of the container body's side panels, comprising: a base member; a continuous peripheral skirt depending downwardly from said base member, a ridge depending downwardly from said base member, said ridge being spaced inwardly from and having a longitudinal axis parallel with said skirt and forming together with said skirt and the portion of said base member between said skirt and said ridge a mounting channel which engages said container mounting seat; several tapered locking lips depending from said ridge and curving outwardly toward yet terminating short of said skirt for urging said container cover down against said mounting channel; and at least one support rib attached to each of said several locking lips, said rib being transverse to the longitudinal axis of said ridge and on the face of each lip opposite said mounting channel such that said ribs stiffen said locking lips once said container cover is mounted onto said container body.

2. The apparatus of claim 1 including a plurality of support ribs equally spaced along the length of the locking lips.

3. The apparatus of claim 2 wherein the tapered locking lip terminates in a beveled edge which urges said lip away from the skirt during the installation of the cover onto the container body mounting seat and wherein the supporting ribs extend from the bottom of the base member to the beveled edge of the locking lip.

4. The apparatus according to claim 3 wherein the cover is integrally molded from a resinous material.

5. The apparatus according to claim 4 wherein the peripheral skirt depends downwardly below the terminal portion of the locking lip.

6. The apparatus according to claim 5 wherein the container cover is rectangular and the locking lips laterally extend along a substantial portion of each edge of said cover.

7. The apparatus according to claim 5 wherein the container cover is circular and includes a plurality of arcual locking lips.

8. The apparatus according to claim 5 wherein the tapered locking lips extend downwardly below the terminal edge of the cover seat.

* * * * *